US005336139A

United States Patent [19]

Miller

[11] Patent Number: 5,336,139

[45] Date of Patent: Aug. 9, 1994

[54] ISOTONIC CERVICAL EXERCISE DEVICE

[76] Inventor: Bruce W. Miller, P. O. Box 20267, Tampa, Fla. 33622

[21] Appl. No.: 134,800

[22] Filed: Oct. 12, 1993

Related U.S. Application Data

[63] Continuation-in-part of Ser. No. 29,874, Mar. 11, 1993, abandoned.

[51] Int. Cl.[5] ..... A63G 9/16

[52] U.S. Cl. ..... 482/10; 482/11; 482/121; 482/124

[58] Field of Search ..... 2/2, 1, 69; 482/10, 482/11, 121, 124

[56] References Cited

U.S. PATENT DOCUMENTS

| | | | |
|---|---|---|---|
| 198,871 | 1/1878 | Case . | |
| 1,618,273 | 2/1927 | Davidson | 482/124 |
| 1,663,641 | 3/1928 | Smallwood . | |
| 2,613,932 | 10/1952 | Manners . | |
| 2,625,202 | 1/1953 | Richardson et al. . | |
| 2,855,202 | 10/1958 | Kinne . | |
| 3,336,922 | 8/1967 | Taylor . | |
| 3,957,040 | 5/1976 | Calabrese . | |
| 4,065,814 | 1/1978 | Fox . | |
| 4,188,966 | 2/1980 | Palmer et al. . | |
| 4,352,352 | 10/1982 | Janovsky et al. . | |
| 4,456,249 | 6/1984 | Calabrese | 482/124 |
| 4,606,542 | 8/1986 | Segal . | |
| 4,645,198 | 2/1987 | Levenston | 482/10 |
| 4,698,847 | 10/1987 | Yoshihara . | |
| 4,832,333 | 5/1989 | Lockett | 482/124 |
| 4,955,608 | 9/1990 | Dougherty et al. . | |
| 5,046,194 | 9/1991 | Alaniz et al. . | |
| 5,062,642 | 11/1991 | Berry et al. . | |
| 5,109,546 | 5/1992 | Dicker . | |
| 5,162,027 | 11/1992 | Robinson | 482/10 |
| 5,186,701 | 2/1993 | Wilkinson | 482/124 |
| 5,201,074 | 4/1993 | Dicker . | |

FOREIGN PATENT DOCUMENTS

| | | | |
|---|---|---|---|
| 480383 | 5/1916 | France . | |
| 2269977 | 5/1975 | France . | |
| 1509073 | 9/1989 | U.S.S.R. | 482/124 |
| 1639-674-A | 7/1991 | U.S.S.R. . | |
| 1048148 | 11/1966 | United Kingdom . | |

*Primary Examiner*—Clifford D. Crowder
*Assistant Examiner*—Gloria Hale
*Attorney, Agent, or Firm*—Arnold, White & Durkee

[57] ABSTRACT

An apparatus for exercising the muscles surrounding the cervical spine of a person, comprising: a belt adapted to be secured about the waist of a person, and including frontal and posterior portions; a pair of suspenders connecting at their frontal ends to opposing frontal portions of the belt, extending over opposing shoulders of the person, and connecting at their posterior ends to opposing posterior portions of the belt; a chin cup adapted to fit around the person's chin; a head band adapted to fit around the person's head and including frontal and posterior portions; a first elastic strap adapted to provide a tensile load between the chin cup and the frontal portion of the belt; and a plurality of elastic straps adapted to provide tensile loads between the frontal portion of the head band, across the person's head, and the posterior portion of the belt or suspenders.

9 Claims, 4 Drawing Sheets

ISOTONIC CERVICAL EXERCISE DEVICE

This application is a continuation-in-part of patent application Ser. No. 029,874 filed Mar. 11, 1993, now abandoned.

BACKGROUND OF THE INVENTION 1. Field of the Invention

The present invention relates generally to exercise devices and, more particularly, to a device designed to strengthen or rehabilitate neck muscles surrounding the cervical spine.

2. Description of the Prior Art

One of the known devices used in the prior art for exercising the human neck, involves the use of a series of straps of cloth material which are sewn or otherwise secured together to form a hat-like pocket for cradling the head of the person whose neck is to be exercised. Portions of the straps are arranged to depend from the hat portion of this prior art device so as to extend substantially below the neck and shoulders of the person performing a neck exercise routine but not, typically, below the waist of such user. The ends of such straps terminate in loops for anchoring suitable weighted objects thereto.

The use of this prior art neck exercising device involves placing the hat portion over the head of the person whose neck is to be exercised, affixing one or more weighted objects to the looped portions of the depending straps and thereafter moving the neck up and down and side to side. The weighted objects provide a constant pull or "force" which is transmitted to the user's neck via the depending straps and the hat structure formed by the sewn straps. The neck is thereby exercised along with the muscles of the human body which are associated with the movement of the human neck. At least one deficiency with this prior art device lies in the inability of the user to comfortably stand up and exercise his neck; the contact of the weighted objects with his body is in some cases intolerable and in other cases, simply a nuisance and a source of irritation.

Another prior art neck exercising device includes an upright frame capable of surrounding the upper torso of a person. This device includes: a pair of handles manual gripping of the frame, a plurality of weighted objects, and some flexible ropes. One end of each rope is secured to one of the weighted objects. The device further includes guide means secured to a frame for guiding each of the plurality of ropes; means for securing the ropes to the weighted objects; and means for securing the unattached ends of the ropes to the head of the person using the device.

The use of this prior art device relies on movements of the weights which are intended to strengthen the neck. This device, however, can present problems when used by patients with a herniated disc. The weights can cause additional compression of the cervical spine and therefore, possibly exacerbate the injuries of the cervical spine. In addition, the use of the frame is cumbersome and a nuisance.

At this time, there is a continuing need for a device for exercising the cervical spine as it relates to rehabilitation of injuries to the cervical spine, deformities of the cervical spine and disease of the spine affecting the neck area. There is also a need for strengthening soft tissues and ligamentous tissues, such as the anterior, posterior and left and right lateral longitudinal ligaments of the cervical spine. A device is especially needed when these areas have been exposed to trauma and injury has resulted. A device is also needed for those people suffering from a weakness in the cervical spine from other causes other than trauma. Especially needed is a device which can address the above needs while depending solely on isotonic responses (without weights) to natural movements, and allows the person to use the device while engaging in almost any type of activity. Such a device would an improvement over the prior art and is described herein.

SUMMARY OF THE INVENTION

The present invention generally concerns an apparatus for exercising the muscles surrounding the cervical spine of a person. The invention more particularly comprises a belt adapted to be secured about the waist of a person, and includes a frontal and posterior portion. The invention further comprises a chin cup adapted to fit around a person's chin, and a head band which is adapted to fit around the person's head and includes frontal and posterior portions. Four adjustable elastic straps are also provided to apply tensile loads.

A first elastic strap is adapted to apply tensile loads between a right frontal portion of the chin cup, diagonally across the person's head, and the posterior portion of the belt. A second elastic strap is adapted to apply tensile loads between a left frontal portion of the chin cup, diagonally across the person's head, and the posterior portion of the belt. A third elastic strap is adapted to apply tensile loads between the front of the chin cup and the front of the belt; and a fourth elastic strap is adapted to apply tensile loads between the frontal portion of the head band, backwards across the person's head, and the posterior portion of the belt.

An alternate embodiment of the invention comprises a pair of suspenders connecting at their frontal ends to opposing frontal portions of the belt, extending over opposing shoulders of the person, intersecting each other along the posterior of the person, and connecting at their posterior ends to opposing posterior portions of the belt. In this embodiment, the frontal ends of the first and second elastic straps connect to the head band and the posterior portions of the first and second elastic straps connect to posterior portions of the suspenders above the intersection of the suspenders. Also in this embodiment, the frontal end of the fourth elastic strap connects to the frontal portion of the head band and the posterior end of the fourth elastic strap connects to the posterior portions of the suspenders proximate the intersection of the suspenders.

Figure 3:
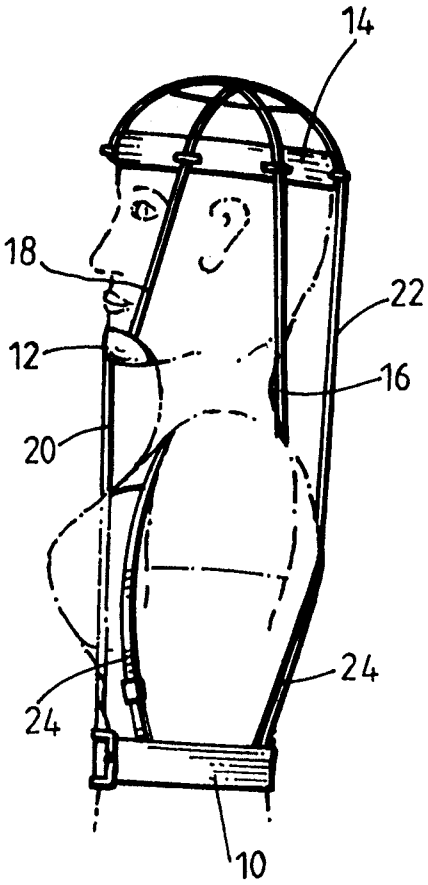
FIG. 3 is the corresponding side view of a person wearing the embodiment of the device of FIG. 1 in a neutral position.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives following within the spirit and scope of the invention as defined by the appended claims.

DETAILED DESCRIPTION OF THE PREFERRED EMBODIMENTS

The present invention is an isotonic cervical exercise device designed to create an isotonic movement of the cervical spine to strengthen the soft tissues, including ligamentous, muscle and other soft tissue connections affecting the cervical spine.

The device generally comprises: a belt adapted to be secured about the waist of a person, including a frontal and posterior portion; a chin cup adapted to fit around a person's chin; a head band adapted to fit around a person's head, including frontal and posterior portions; a pair of suspenders connecting at their frontal ends to opposing frontal portions of the belt, extending over opposing shoulders of the person, intersecting each other along the posterior of the person, and connecting at their posterior ends to opposing posterior portions of the belt; and a plurality of properly placed bungee or elastic straps adapted to provide tensile loads from the chin cup to the frontal portion of the belt, from the chin cup diagonally across the temporal portion of a person's head to the head band and to the posterior portion of the suspenders, and from the frontal portion of the head band across the person's head to the posterior portion of the suspenders.

The device operates in an isotonic manner. Each of the elastic straps are adjustable so that when the device is placed on a person, each strap is tightened to the point of resistance. The point of resistance is the amount of tension that occurs just prior to the point where a pulling effect occurs. Thus, when the device is in operation, any movement caused by the person, such as anterior flexion, posterior extension, left and right lateral flexion or left and right rotation is affected by the restraint effect of the elastic straps, thereby accomplishing an isotonic type of resistance for building of the soft tissue surrounding the spine.

This device is unique because it requires only the movement of the cervical spine in a natural motion in order to achieve an isotonic response and thus strengthen the tissue surrounding the cervical spine. It achieves the foregoing result without the need of cumbersome weights. In addition, it does not depend on an isometric response, which is a force against an unmovable source. Therefore, the device allows a person to engage in almost any type of activity while wearing (operating) the device, including, but not limited to, household activities and work activities, whether sitting, lying, standing or walking.

Figure 2:
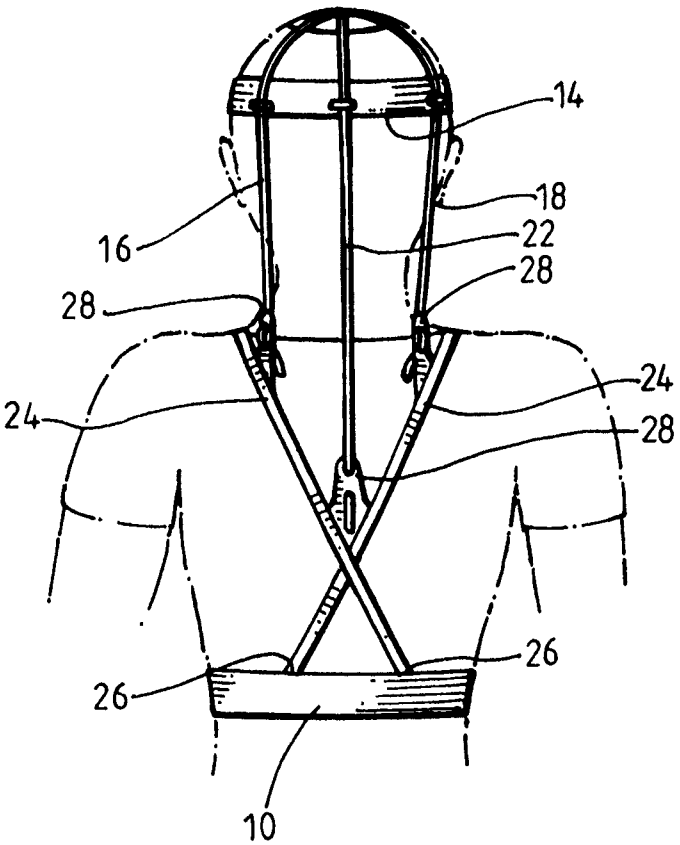
FIG. 2 is a posterior view of a person wearing an embodiment of the invention in a neutral position.
Figure 1:
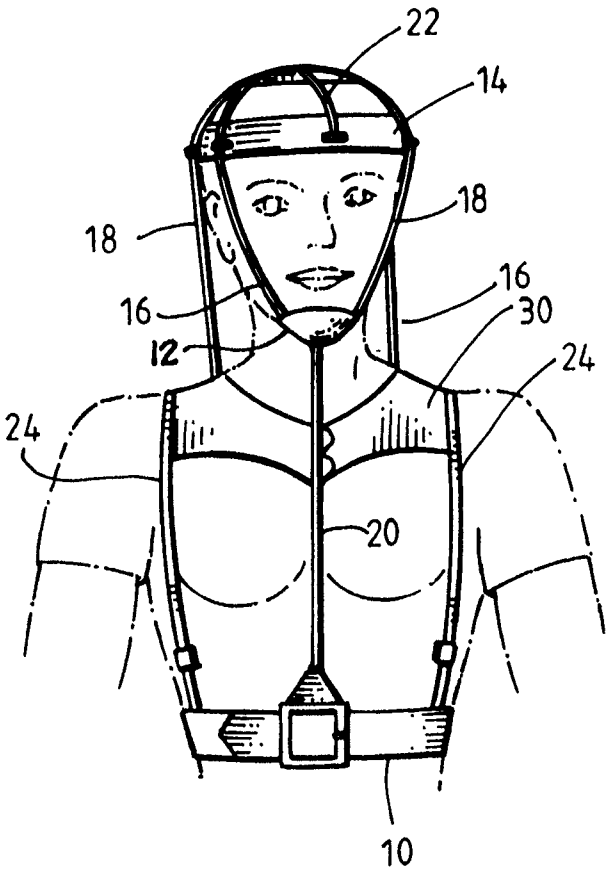
FIG. 1 is a front view of a person wearing an embodiment of the invention in a neutral position.

Turning now to the drawings, FIG. 1 is a front view of a person wearing an embodiment of the isotonic cervical exercise device in a neutral position. FIG. 2 is a posterior view of a person wearing an embodiment of the isotonic cervical exercise device in a neutral position. Referring to FIGS. 1 and 2, a belt 10 is adapted to be secured about the waist of the person, and includes frontal and posterior portions corresponding to the respective sides of the person's body. A chin cup 12 is adapted to fit comfortably around the person's chin. A head band 14 is adapted to fit around the person's head and includes frontal and posterior portions. A pair of adjustable suspenders 24 connect at their frontal ends to opposing frontal portions of the belt 10, extend over opposing shoulders of the person, intersect each other along the posterior of the person, and connect at their posterior ends to opposing posterior portions of the belt 10. A garment member 30 is adapted to fit across the upper chest of the person and connects at opposite sides to suspenders 24. A first adjustable elastic strap 16 connects at a first end to a right frontal portion of the chin cup 12, extends diagonally across a person's head, connects at a second end to the posterior portion of the belt 10 or the posterior portion of the suspenders 24, and is adapted to apply tensile loads between said first and second end. A second adjustable elastic strap 18 connects at a first end to a left frontal portion of the chin cup 12, extends diagonally across the person's head, connects at a second end to the posterior portion of the belt 10 or the posterior portion of suspenders 24, and is adapted to apply tensile loads between said first and second end. A third adjustable elastic strap 20 is adapted to apply tensile loads between the front of the chin cup 12 and the frontal portion of the belt 10, and therefore connects at a first end to the front portion of the chin cup 12 and connects at a second end to the frontal portion of the belt 10. A fourth adjustable elastic strap 22 connects to a frontal portion of the head band, extends backward across the person's head, connects at a second end to the posterior portion of the belt 10 or the posterior portion of suspenders 24, and is adapted to apply tensile loads between said first and second end.

In the embodiment shown in FIGS. 1 and 2, the posterior ends of first elastic strap 16, second elastic strap 18 and fourth elastic strap 22 connect to the posterior portion of suspenders 24. In particular, the posterior ends of first elastic strap 16 and second elastic strap 18 connect to posterior portions of the suspenders 24 above the intersection of the suspenders, while the posterior end of the fourth elastic strap 22 connects to the posterior portions of the suspenders proximate the intersection of the suspenders 24. FIG. 2 shows the posterior portions of head band 14, belt 10 and suspenders 24. FIG. 2 also shows the posterior portion of suspenders 24 intersecting each other along the posterior of the person and connecting at their posterior ends 26 to the posterior portion of belt 10. FIG. 2 also shows an embodiment of the adjustment means 28.

FIG. 3 is the corresponding left side view of a person wearing the embodiment of the invention shown in FIGS. 1 and 2.

Figure 4:
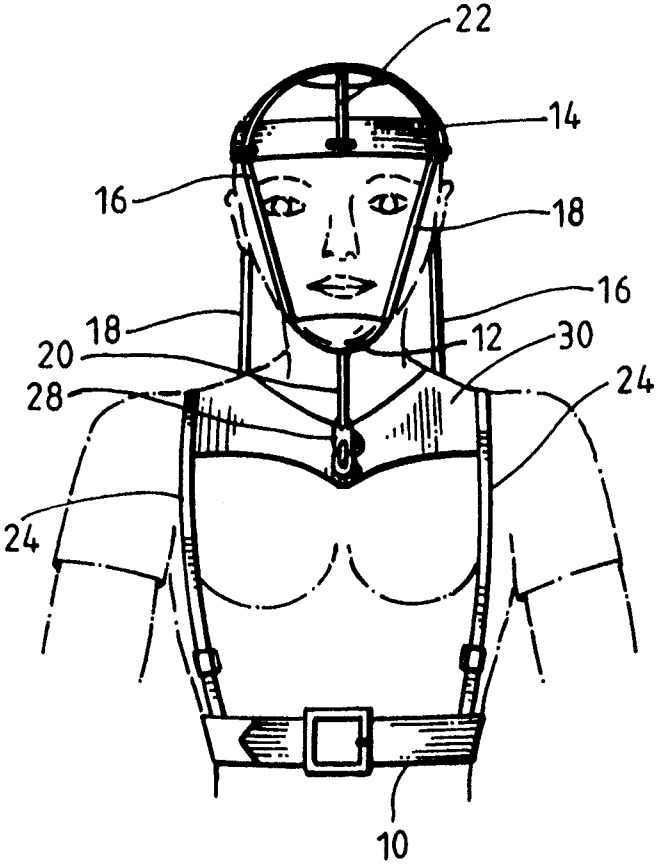
FIG. 4 is a front view of a person wearing an embodiment of the device in a neutral position.

FIG. 4 shows another embodiment of the invention. In this embodiment, the third adjustable elastic strap 20 is adapted to apply tensile loads between the front of the chin cup 12 and the garment member 30. The third adjustable elastic 20 connects to garment member 30 through an embodiment of adjustment means 28.

Figure 5:
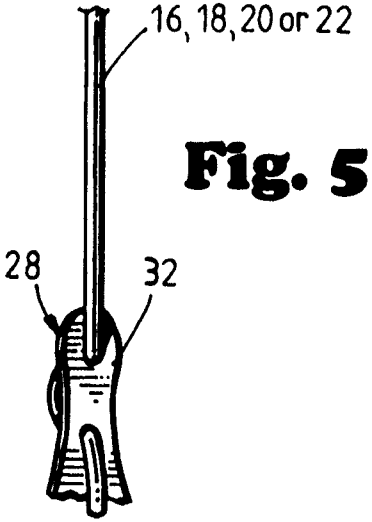
FIG. 5 is a pictorial view of the adjustable means of the elastic straps of the device.

FIG. 5 is a pictorial view of an embodiment of adjustment means 28. The embodiment of adjustment means 28 shown in FIG. 5 comprises an adjustable elastic strap 16, 18, 20 or 22 and a material portion 32. The material portion 32 further comprises at least two holes in which the adjustable elastic strap is placed through as shown in FIG. 5.

Figure 6:
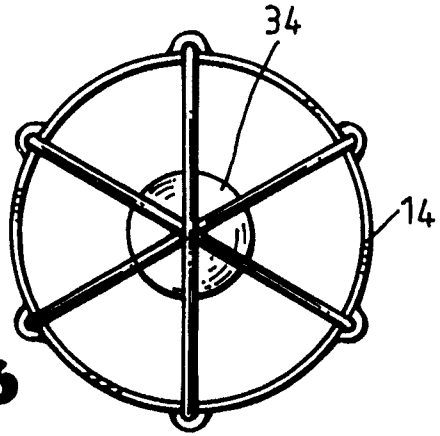
FIG. 6 is a top view of the head band portion of the invention.

FIG. 6 is a top view of a person's head showing an embodiment of the invention which includes a bonnet 34 located at the intersection of adjustable elastic straps 16, 18 and 22. The bonnet 34 can comprise a sheet of any suitable material which comfortably cushions the tension of the elastic straps against the top of a person's head.

Figure 7:
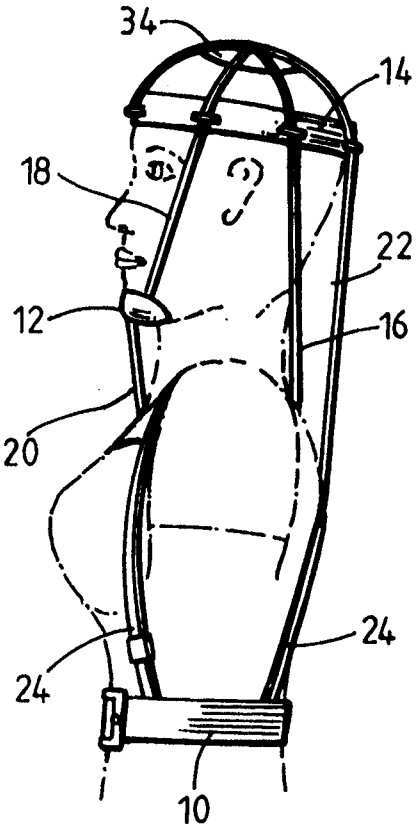
FIG. 7 is the corresponding side view of a person wearing the embodiment of the device shown in FIG. 3 in a neutral position.

FIG. 7 is the corresponding left side view of a person wearing the embodiment of the invention shown in FIG. 4 wherein the third adjustable elastic strap 20 is adapted to apply tensile loads between the front of chip cup 12 and garment member 30.

Figure 8:
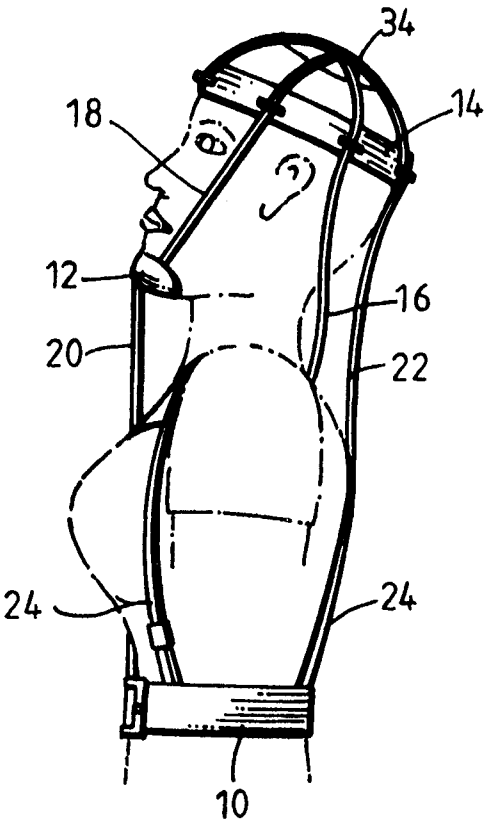
FIG. 8 is a side view of a person wearing the embodiment of the invention shown in FIG. 1 in a operating position.

FIG. 8 is a left side view of a person wearing the embodiment of the invention shown in FIG. 1 in an operating position. The person in FIG. 8 is shown with her head in a tilted back position. In this position, elastic strap 20 is in tension and provides isotonic resistance to certain muscles surrounding the person's cervical spine.

Figure 9:
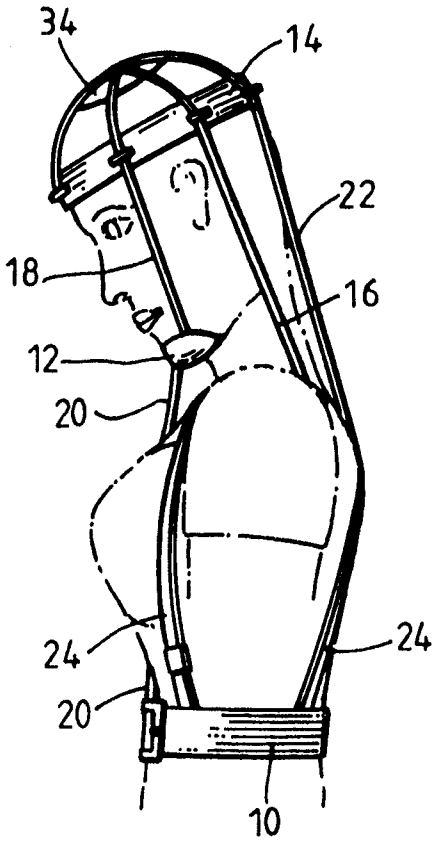
FIG. 9 is a side view of a person wearing the embodiment of the invention shown in FIG. 1 in a operating position.

FIG. 9 is a left side view of a person wearing the embodiment of the invention shown in FIG. 1 in an operating position. The person in FIG. 9 is shown with her head in a forward tilted position. In this position, elastic straps 16, 18 and 22 are in tension and provide isotonic resistance to certain muscles surrounding the person's cervical spine.

Figure 10:
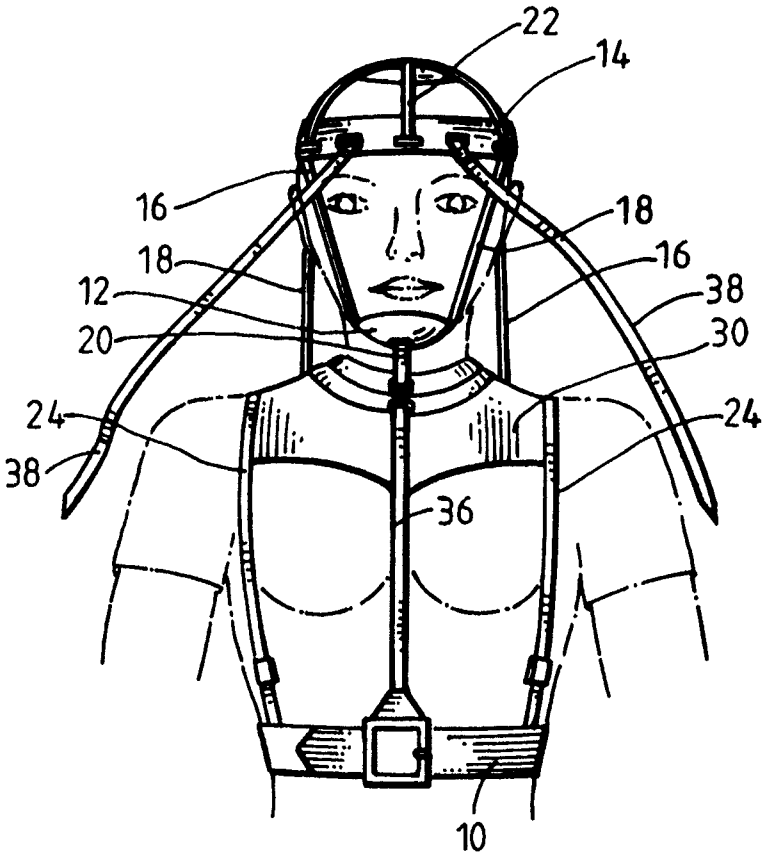
FIG. 10 is a front view of a person wearing an embodiment of the invention.

FIG. 10 shows another embodiment of the invention. In this embodiment, two detachable elastic straps 38 are adapted to connect at their first ends to the frontal portion of head band 14 and extend freely downward at their second ends. The elastic straps 38 are adapted to easily attach or detach at the frontal portion of head band 14. Also, in the embodiment shown in FIG. 10, the third elastic strap 20 is adapted to apply tensile loads between the front of the chin cup 12 and the upper frontal portion of garment 30. Therefore, elastic strap 20 connects at a first end at the front of chin cup 12 and at a second end to the frontal portion of garment 30 near the collar. Also shown in the embodiment of FIG. 10, is a fifth elastic strap 36 adapted to apply tensile loads between the frontal portion of garment 30 and the frontal portion of belt 10. Thus, the fifth elastic strap 36 connects at a first end below elastic strap 20 at the collar of garment 30 and at a second end to the frontal portion of belt 10.

Figure 11:
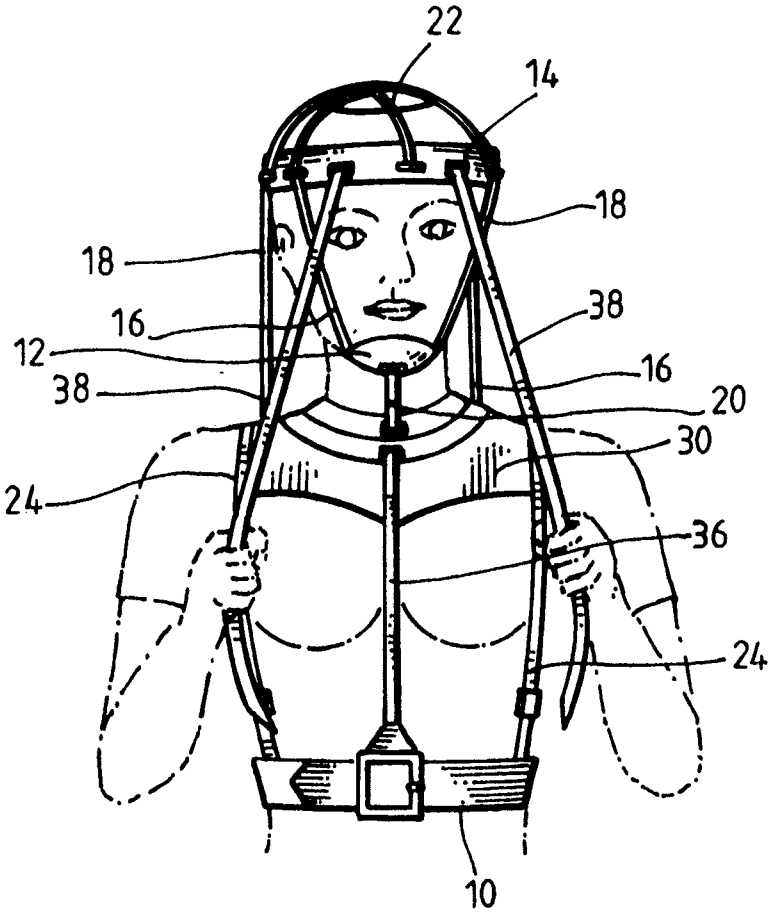
FIG. 11 is a front view of a person operating the embodiment of the invention shown in FIG. 10.

FIG. 11 shows a person operating the embodiment of the invention shown in FIG. 10. To operate the embodiment of the invention shown in FIG. 10, the person grasps the free ends of elastic straps 38 with their hands and pulls elastic straps 38 in a forward or side motion. The other elastic straps 16, 18, 20, 22 and 36 are at the point of resistance, and therefore, the pulling of elastic straps 38 will cause isotonic resistance to affect the muscles surrounding the cervical spine.

Figure 12:
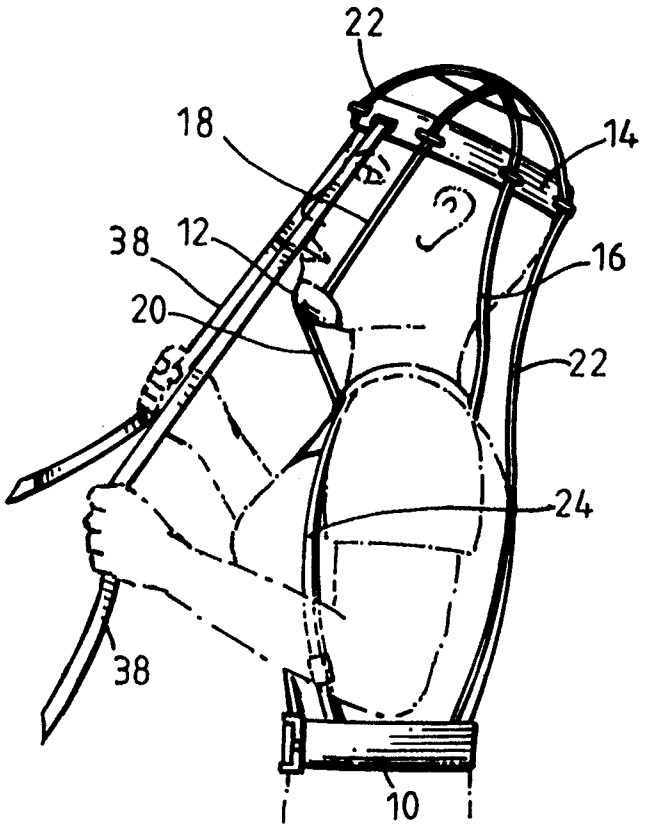
FIG. 12 is a side view of a person operating the embodiment of the invention shown in FIG. 10.

FIG. 12 is a side view of a person operating the embodiment of the invention shown in FIG. 11.

What is claimed is:

1. An apparatus for exercising the muscles surrounding the cervical spine of a person, comprising:

a belt adapted to be secured about the waist of a person, and including frontal and posterior portions;

a chin cup adapted to fit around the person's chin;

head band adapted to fit around the person's head and including frontal and posterior portions;

a first elastic strap having one end attached to the chin cup and a second end attached to the frontal portion of the belt to provide a tensile load therebetween; and a plurality of elastic straps engaging the frontal portion of the head band, extending across the person's head, and having an end attached to the posterior portion of the belt to provide tensile loads therebetween.

2. An apparatus for exercising the muscles surrounding the cervical spine of a person, comprising:

a belt adapted to be secured about the waist of a person, and including frontal and posterior portions;

a chin cup adapted to fit around the person's chin;

a head band adapted to fit around the person's head and including frontal and posterior portions;

a first elastic strap connecting at a first end to a right frontal portion of the chin cup, extending diagonally across the person's head, connecting at a second end to the posterior portion of the belt, and adapted to apply tensile loads between said first and second end;

a second elastic strap connecting at a second end to a left frontal portion of the chin cup, extending diagonally across the person's head, connecting at a first end to the posterior portion of the belt, and adapted to apply tensile loads between said first and second end;

a third elastic strap connecting at a first end to the front of the chin cup and connecting at a second end to the frontal portion of the belt, and adapted to apply tensile loads between said first and second end; and a fourth elastic strap connecting at a first end to the frontal portion of the head band, extending backward across the person's head, connecting at a second end to the posterior portion of the belt, and adapted to apply tensile loads between said first and second ends.

3. The apparatus of claim 2 which further comprises a pair of suspenders connecting at their frontal ends to opposing frontal portions of the belt, extending over opposing shoulders of the person, intersecting each other along the posterior of the person, and connecting at their posterior ends to opposing posterior portions of the belt.

4. The apparatus of claim 2 wherein the frontal ends of the first and second elastic straps connect to the head band and the posterior portions of the first and second elastic straps connect to posterior portions of the suspenders above the intersection of the suspenders.

5. The apparatus of claim 4 wherein the frontal end of the fourth elastic strap connects to the frontal portion of the head band and the posterior end of the fourth elastic strap connects to the posterior portions of the suspenders proximate the intersection of the suspenders.

6. The apparatus of claim 4 further comprising a garment member adapted to fit across the upper chest of the person and connecting at opposite sides to said suspenders.

7. The apparatus of claim 2 further comprising a bonnet located at the intersection of said first, second and fourth elastic straps on top of the person's head.

8. The apparatus of claim 2 wherein the third elastic strap connects to the frontal portion of the chin cup at one end and said garment member at the opposite end.

9. An apparatus for exercising the muscles surrounding the cervical spine of a person, comprising:

a belt adapted to be secured about the waist of a person, and including frontal and posterior portions;

a chin cup adapted to fit around the person's chin;

a head band adapted to fit around the person's head and including frontal and posterior portions;

a first elastic strap connecting at a first end to a right frontal portion of the chin cup, extending diagonally across the person's head, connecting at a second end to the posterior portion of the belt, and adapted to apply tensile loads between said first and second end;

a second elastic strap connecting at a first end to a left frontal portion of the chin cup, extending diagonally across the person's head, connecting at a second end to the posterior portion of the belt, and adapted to apply tensile loads between said first and second end;

a third elastic strap connecting at a first end to a frontal portion of the chin cup, connecting at a second end to the frontal portion of the garment, and adapted to apply tensile loads between said first and second end;

a fourth elastic strap connecting at a first end to the frontal portion of the head band, extending backward across the person's head, connecting at a second end to the posterior portion of the belt, and adapted to apply tensile loads between said first end and second end;

a fifth elastic strap connecting at a first end to the frontal portion of the garment, connecting at a second end to the frontal portion of the belt, and adapted to apply tensile loads between said first and second end; and two elastic straps connected at their first ends to the head band and extending freely at their second ends.

* * * * *